United States Patent [19]

Heijting

[11] 4,373,368

[45] Feb. 15, 1983

[54] HYDRAULIC ASSIST STRIPPING

[75] Inventor: Hendrik G. Heijting, Deventer, Netherlands

[73] Assignee: Thomassen & Drijver-Verblifa NV, Deventer, Netherlands

[21] Appl. No.: 278,783

[22] Filed: Jun. 29, 1981

[51] Int. Cl.[3] ..... B71D 45/00

[52] U.S. Cl. ..... 72/344; 72/345; 72/349; 72/427

[58] Field of Search ..... 72/344, 345, 347, 348, 72/349, 427

[56] References Cited

U.S. PATENT DOCUMENTS

| | | | |
|---|---|---|---|
| 2,983,366 | 5/1961 | Pevret | 72/344 |
| 3,402,591 | 9/1968 | Maeder | 72/345 |
| 3,524,338 | 8/1970 | Bozel | 72/345 |
| 3,537,291 | 11/1970 | Hawkins | 72/345 |
| 3,771,344 | 11/1973 | Wright | 72/345 |
| 3,911,718 | 10/1975 | Requarth | 72/344 |
| 3,972,217 | 8/1976 | Misonoo | 72/344 |

*Primary Examiner*—Leon Gilden

*Attorney, Agent, or Firm*—Charles E. Brown· John J. Kowalik

[57] ABSTRACT

A method and apparatus for forming a cylindrical wall-ironed sleeve having a bottom and a radially inwardly enlarged wall thickness at an end remote from said bottom with there being an internally tapered transition region between a normal wall thickness and the enlarged wall thickness, said method including the forming of the sleeve on a mandrel with said enlarged wall thickness being interlocked with said mandrel; the step of introducing a fluid under pressure through the mandrel between the mandrel and the sleeve at the transition region of the sleeve to momentarily radially enlarge the end of the sleeve remote from the bottom and release the inter-lock between the sleeve and the mandrel.

9 Claims, 3 Drawing Figures

FIG. 1
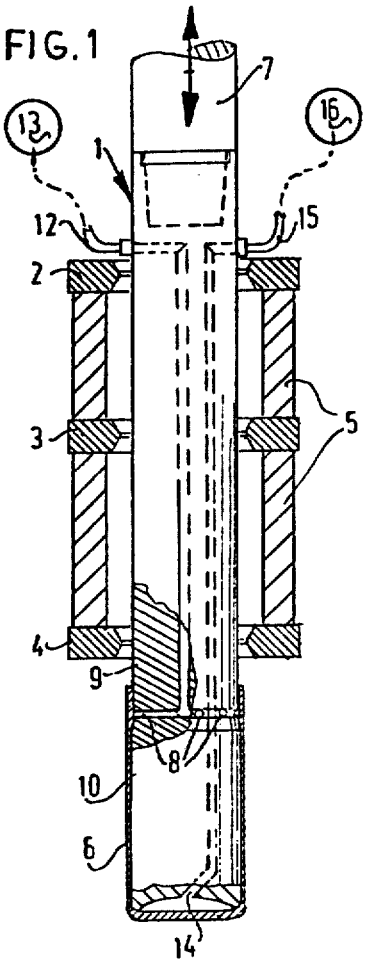
FIG. 2
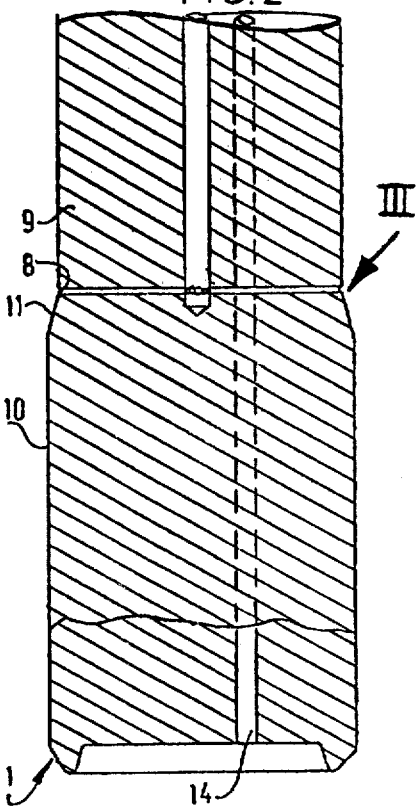
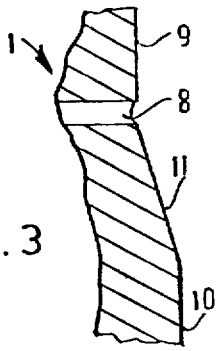
FIG. 3

HYDRAULIC ASSIST STRIPPING

The invention relates to a method of releasing a wall-ironed sleeve having an enlarged wall thickness at the end remote from the bottom from a wall-ironing mandrel. Such a method is known from U.S. Pat. No. 3,524,338. According to the technique taught by said U.S. patent a pressurized fluid is introduced at the front face of the wall-ironing mandrel. For a good understanding of the disadvantageous effects of such a method it is pointed out that attempts have to be made to overcome the clamping force by which the sleeve is shrunk on the wall-ironing mandrel. This clamping force is generated by cooling down after heating during the wall-ironing process.

By the introduction of pressurized fluid at the front face of the mandrel the bottom of the wall-ironed sleeve is very heavily loaded so that it may readily be plastically deformed or damaged. This load serves to produce a tractive force exceeding the frictional force to be overcome, produced by the sleeve being clamped to the mandrel as described above. This mode of operation involves that exclusively sleeves of a material having a relatively low Young's modulus can be used. The known method of the aforesaid U.S. patent cannot possibly by used for construction materials having higher Young's moduli, for example, sheet iron, steel or the like.

A further disadvantage of the prior art is that the introduction of fluid at the front face of the wall-ironing mandrel brings about the risk of bottom deformation as well as the risk of the sleeve being, so to say, shot away, which may give rise to unsatisfactory process control and to disturbances in automatic processes.

The invention has for its object to obviate the disadvantages of the prior art and provides a method of the kind set forth in which the fluid is allowed to enter at the transitional region between the normal wall thickness and the enlarged wall thickness. It is pointed out that the axial position of the admission of the fluid corresponds to a region where no wall-ironing operation takes place, since otherwise fluid inlet apertures might become clogged, the fluid being now admitted as near as possible the zone where the operation concerned is carried out in order to maximize the effect.

The fluid pressure preferably amounts to at least 10 bars. Experiments with tinned iron sleeves having a wall thickness of about 0.1 mm have shown that, for example, at a fluid pressure of about 25 bars the sleeve can be released substantially without friction.

The invention furthermore relates to a wall-ironing mandrel suitable for carrying into effect the method according to the invention, said mandrel having a cylindrical, relatively broad part, a cylindrical, relatively narrow part coaxial to the former and a substantially conical part interconnecting said two cylindrical parts and at least one fluid inlet conduit opening out at the operative surface, said wall-ironing mandrel being characterized in accordance with the invention in that the at least one fluid inlet conduit opens out in the region of the transitional part between the cylindrical, relatively narrow part and the conical part.

Preferably, a plurality of fluid inlet apertures are arranged along the circumference.

In order to reliably prevent the sleeve from being explosively released, there is preferably provided at least one pressure equalizing duct opening out at the front face. This excludes at the same time any risk of the atmospheric pressure between the front face of the mandrel and the bottom of the sleeve deforming the sleeve bottom and the neighbouring wall parts.

A very simple embodiment is obtained in which the pressure equalizing duct is in open communication with the atmosphere.

By the method and the wall-ironing mandrel according to the invention sleeves having wall thicknesses of even less than 0.1 mm can be stripped off the wall-ironing mandrel without deformation of the material.

According to the invention an appreciable saving of material can be obtained by reducing length differences between the initially manufactured and the finally trimmed sleeves. Moreover, disturbances of the process are minimized, which is conducive to the productivity, whilst in addition the various tools have a considerably longer lifetime, which means saving of costs.

The invention will be described more fully with reference to a drawing. This drawing shows in FIG. 1 a schematic cross-sectional view of a device for carrying out the method embodying the invention, FIG. 2 a cross-sectional view of a wall-ironing mandrel embodying the invention, and FIG. 3 a detail indicated by III in FIG. 2.

The device schematically shown in FIG. 1 comprises a wall-ironing mandrel 1 embodying the invention, a first wall-ironing ring 2, a second wall-ironing ring 3, a third wall-ironing ring 4 as well as a frame 5 interconnecting the three wall-ironing rings. The wall-ironing mandrel is axially driven by means of a plunger 7 actuated by means not shown and being rigidly connected by known coupling means with the wall-ironing mandrel 1. In the situation shown the device is in that stage of the wall-ironing process in which a formed sleeve 6 has to be released from the wall-ironing mandrel 1.

In this embodiment of the invention the wall-ironing mandrel has a plurality of circumferentially disposed fluid inlet apertures 8 located in the area of a transitional part shown in the drawing, particularly FIGS. 2 and 3, between the relatively narrow part 9 of the wall-ironing mandril 1 and the conical part 11 connecting the narrow part 9 with the relatively broad part 10 with a view to the releasing operation.

The fluid inlet apertures 8 communicate in the manner illustrated in FIG. 1 through a flexible pressure duct 12 with a source 13 of pressurized fluid.

This pressurized fluid source is energized synchronously with the displacement of the plunger 7 or continuously in a manner such that the releasing operation takes place after the accomplishment of the wall-ironing operation proper.

With respect to the specific positions of the apertures 8 in the embodiment concerned it is noted that if the apertures are nearer the open end of the sleeve the effectiveness is lower, whereas if the apertures are nearer the bottom, material will be pressed into the apertures during the wall-ironing operation, which would render the release more difficult, whilst during release scraps of material might settle on the outer side of the mandrel.

At its front face the wall-ironing mandrel 1 has a fluid inlet aperture 14 which communicates in the manner shown in FIG. 1 through a second pressure duct 15 with a second source 16 of pressurized fluid, for example, compressed air. This source is also energized synchronously with the displacement of the plunger 7 or else permanently.

Various variants of the embodiment shown are possible. For example, the axial positions of the apertures 8 may be chosen within wide limits on either side.

I claim:

1. A method of forming a cylindrical wall-ironed sleeve having a bottom and a radially inwardly enlarged wall thickness at an end remote from said bottom with there being an internally tapered transition region between a normal wall thickness and the enlarged wall thickness, said method including the forming of the sleeve on a mandrel with said enlarged wall thickness being interlocked with said mandrel; the step of introducing a fluid under pressure through the mandrel between the mandrel and the sleeve at the transition region of the sleeve to momentarily radially enlarge the end of the sleeve remote from the bottom and release the interlock between the sleeve and the mandrel.

2. A method according to claim 1 wherein the fluid pressure is at least 10 bars.

3. A method according to claim 1 wherein fluid is also directed through the mandrel against the sleeve bottom to axially disengage the sleeve from the mandrel.

4. A wall-ironing mandrel for forming a wall-ironed sleeve of the type having a bottom and a radially inwardly enlarged wall thickness at an end remote from the bottom with there being an internally tapered transition region between a normal sleeve wall thickness and the enlarged wall thickness, said mandrel having an external configuration corresponding to the internal shape of the sleeve and including a primary larger diameter cylindrical part and a secondary smaller diameter cylindrical part joined by an intermediate conical part corresponding to the taper of the sleeve transition region; said mandrel being improved by at least one fluid conduit from a pressurized fluid source opening radially outwardly through said conical surface outwardly through said conical surface and forming means for momentarily radially enlarging an enlarged wall thickness end of a sleeve to release the sleeve from said mandrel.

5. A wall-ironing mandrel according to claim 4 wherein there are a plurality of said fluid conduits arranged in circumferentially spaced relation.

6. A wall-ironing mandrel according to claim 4 wherein said fluid conduit opens into an annular groove extending around the exterior of said mandrel.

7. A wall-ironing mandrel according to claim 4 wherein said fluid conduit opens into an annular groove extending around the exterior of said mandrel generally at the intersection of said smaller diameter cylindrical part and said intermediate conical part.

8. A wall-ironing mandrel according to claim 4 wherein there is at least one pressure equalizing duct in said mandrel through the configurated surface and further externally of said mandrel.

9. A wall-ironing mandrel according to claim 4 wherein there is at least one pressure equalizing duct in said mandrel through the configurated surface and further externally of said mandrel to the atmosphere.

* * * * *